US005634389A

United States Patent [19]

Horan et al.

[11] Patent Number: 5,634,389

[45] Date of Patent: Jun. 3, 1997

[54] ACTUATOR STIFFNESS ENHANCING SYSTEM

[75] Inventors: Christopher J. Horan, Huntington; Harry A. Lamont, Dix Hills; Theodore A. Sorenson, Islip; Martin C. Stettler, Stony Brook, all of N.Y.

[73] Assignee: Northrop Grumman Corporation, Los Angeles, Calif.

[21] Appl. No.: 158,211

[22] Filed: Nov. 29, 1993

[51] Int. Cl.[6] ..... F15B 11/08

[52] U.S. Cl. ..... 91/445; 60/406

[58] Field of Search ..... 91/445, 510; 60/406, 60/468

[56] References Cited

U.S. PATENT DOCUMENTS 2,633,153 3/1953 Gunn ..... 91/445

4,338,965 7/1982 Garnjost et al. ..... 91/510

4,644,849 2/1987 Tanaka ..... 91/445

*Primary Examiner*—F. Daniel Lopez

*Attorney, Agent, or Firm*—Terry J. Anderson; Karl J. Hoch, Jr.

[57] ABSTRACT

A fluidic stiffness enhancing circuit for use with a fluid driven piston type actuator includes a fluid conduit arrangement that interconnects two variable volume chambers of the actuator upon occurrence of a loss of system pressure to at least one of the chambers. The fluid conduit arrangement incorporates an inertance device for controlling the rate of flow of fluid therethrough so as to control the pressures in the two chambers in response to external forces applied to the actuator piston and thereby the stiffness of the actuator.

7 Claims, 1 Drawing Sheet

ACTUATOR STIFFNESS ENHANCING SYSTEM

BACKGROUND OF THE INVENTION

1. Field of the Invention

The present invention pertains to the art of fluid driven actuator systems and, more particularly, to a fluidic stiffness enhancing system for use with fluid driven actuators.

2. Discussion of the Prior Art

Fluid driven actuators are widely known in the art. In many environments in which actuators are used, an important property of the actuator is its stiffness. In general, a fluid driven actuator includes at least one cylinder that is divided into two variable volume chambers by a piston. Such actuators can be configured as linear or rotary, as is well known in the field of fluid actuators. Fluid pressure can be selectively supplied to either of the two chambers fluidly through a servo-valve or the like to drive the piston, which actually repositions a motion output piston rod or shaft to which the piston is secured. The actuator normally possesses a "stiffness" that can be described in terms of the resistance of the piston to motion in response to an exterior force applied directly to the piston rod. However, if a system failure occurs that results in a pressure loss in one of the chambers, the chamber cannot contribute to the stiffness (i.e., resistance to piston rod movement) of the actuator. It is highly desirable in many applications, particularly in aerospace or aircraft environments, to maintain high stiffness in an actuator that may suddenly lose system pressure.

It would be desirable in the event of such a failure for the chamber to still contribute to the stiffness of the actuator. Ideally, the chamber would provide little resistance to motion at low, control frequencies, yet provide a high degree of resistance to high frequency forces, such as flutter forces developed on a control surface of an aircraft in flight.

Therefore, there exists a need in the art for a system for use in enhancing the stiffness of a fluid driven actuator in the event of a failure in the ability of at least one of the chambers of the actuator to contribute to the stiffness of the actuator.

SUMMARY OF THE INVENTION

It is an object of the present invention to provide a fluidic stiffness enhancing system for use with a fluid driven actuator which will enable the actuator to maintain a desired stiffness in the event that supply pressure is lost to one of the chambers of the actuator.

It is another object of the present invention to provide a fluidic stiffness enhancing system for a fluid driven actuator which will enable the actuator to exhibit little resistance to low, control frequencies and a high degree of resistance to high frequency forces even in the event of a failure in the supply of fluid pressure to one of the chambers of the actuator.

These and other objects of the invention are realized by connecting the chambers of a fluid driven actuator to a source of supply pressure and, in the event of a failure in the supply of pressure to at least one of the chambers, automatically fluidly interconnecting the two chambers through a special conduit system. The special conduit system includes an inertance device for controlling the permissible rate of flow of fluid therethrough so as to control the pressure differential and the rate of change of such pressure differential between the two chambers. Preferably, the flow characteristics of the inertance device can be varied so as to alter the stiffness versus frequency response of the actuator to suit the particular environment in which the actuator is utilized.

These and other objects, features and advantages of the present invention will become more readily apparent from the following detailed description of a preferred embodiment of the invention with reference to the accompanying drawing.

DETAILED DESCRIPTION OF THE PREFERRED EMBODIMENT

Figure 1:
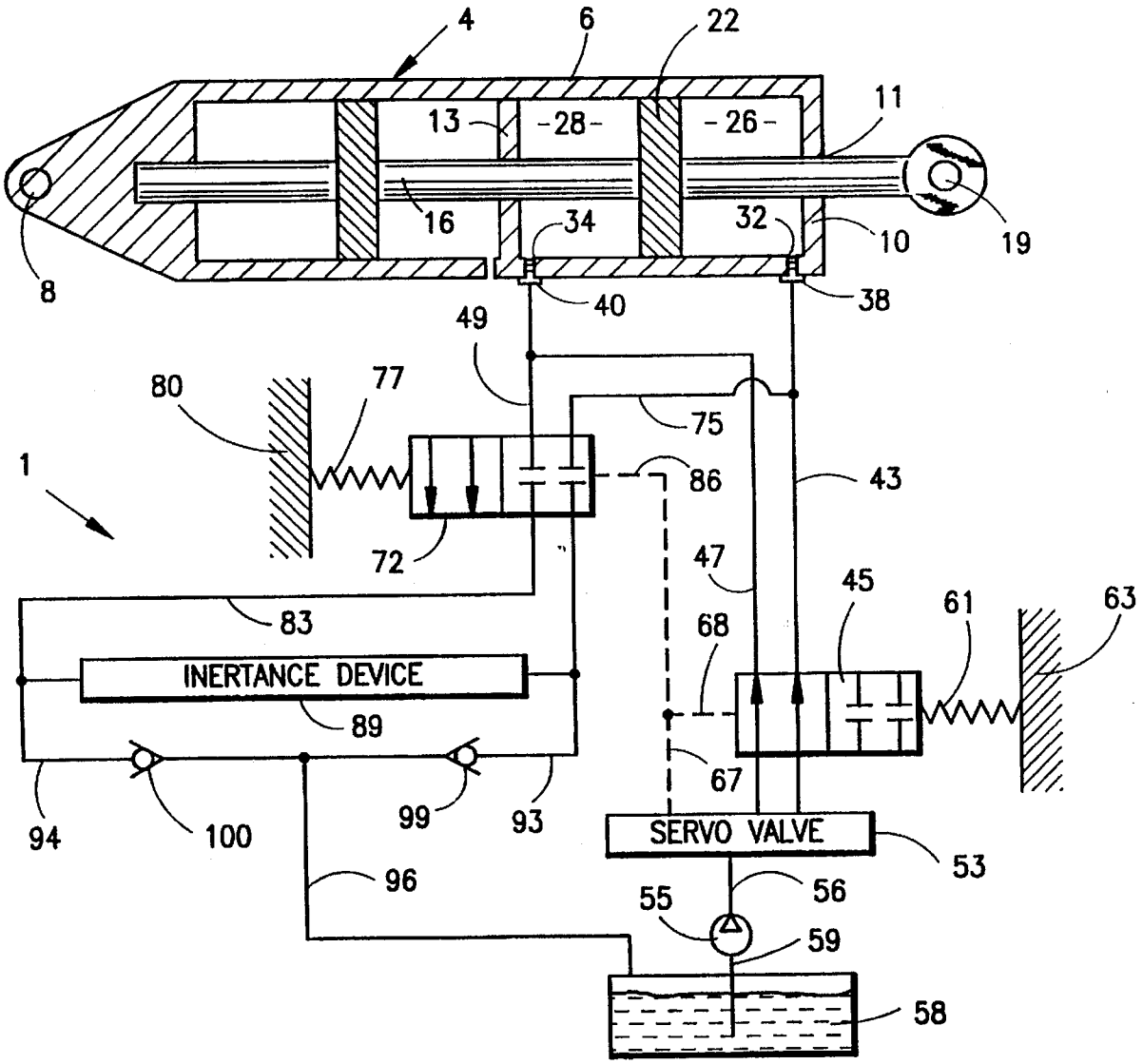
FIG. 1 depicts a cross-sectional view of a fluid driven linear actuator in combination with the fluidic stiffness enhancing circuit of the present invention.

The fluidic stiffness enhancing circuit of the present invention is generally indicated at 1 in FIG. 1 and is in fluid communication with a fluid driven exemplary linear actuator 4. Linear actuator 4 includes a cylinder 6 having a mounting aperture 8 at one end thereof and an end wall 10, having a central through hole 11, at its other end. The linear actuator 4 depicted actually comprises a dual tandem linear actuator and therefore cylinder 6 includes a dividing wall 13. Since the structure of linear actuator 4 on either side of dividing wall 13 is the same, only the portion of linear actuator 4 to the right of dividing wall 13 as viewed in FIG. 1 shall be described in detail below. It is to be understood that the linear actuator embodiment is exemplary and the actuator used in the system embodying the inventive concept could be rotary as well.

Linear actuator 4 further includes a piston rod 16 having an eyelet 19 formed or attached at one end thereof. Piston rod 16 extends through hole 11 in 15 end wall 10 and through a central through hole (not labeled) in dividing wall 13. Piston rod 16 has fixedly secured thereto a piston 22 which divides the portion of cylinder 6 between end wall 10 and dividing wall 13 into first and second variable volume chambers 26 and 28.

Cylinder 6 is formed with a hole 32 which opens into first variable volume chamber 26 adjacent to end wall 10. Likewise, cylinder 6 includes another hole 34 opening up into second variable volume chamber 28 adjacent to dividing wall 13. Holes 32 and 34 have sealed fittings 38 and 40, respectively. Fittings 38 and 40 can be secured within holes 32 and 34 by threaded connections in a fluid tight manner as is known in the art. A first fluid conduit 43 is attached to fitting 38 at one end so as to open into first variable volume chamber 26 and extends to a first, two-position valve 45. In a similar manner, a second fluid conduit 47 is in fluid communication with first, two-position valve 45 and with second variable volume chamber 28 by means of a segment of a third fluid conduit 49, one end of which is attached to fitting 40 and opens into second variable volume chamber 28.

In the position shown in FIG. 1, first, two-position valve 45 fluidly interconnects first and second fluid conduits 43, 47 with a servo-valve 53 which, in turn, receives fluid pressure from a pump 55 through a supply line 56. In the embodiment shown, pump 55 is intended to depict a generic type of fluid pressure supply source and, actually, pump 55 could be the main fluid pressure supply source for other systems as well. Pump 55 is adapted to draw system fluid from a sump tank or reservoir 58 through an intake line 59. First, two-position valve 45 is biased to the left as viewed in FIG. 1 by means of a spring 61 that extends between first, two-position valve 45 and a fixed structure 63. First, two-position valve 45 is biased in an opposite direction, i.e., to the right as viewed in FIG. 1, by means of a supply of system pressure delivered through servo-valve 53 and supply lines 67 and 68. The particular structure of servo-valve 53 is not depicted in detail in FIG. 1 since such valves are well-known, and apparent to a person skilled in the art. For example, servo-valve 53 could comprise a sliding spool valve which is shifted based on varying pressures acting upon lands there of, preferably, a solenoid control valve that is shifted based on electrical signal from a control system.

Third fluid conduit 49 is also fluidly connected to a second, two-position valve 72. A fourth fluid conduit 75 interconnects first fluid conduit 43 to second, two-position valve 72. Second, two-position valve 72 is biased to the right as viewed in FIG. 1 by means of a spring 77 that extends between second, two-position valve 72 and a fixed structure 80. In this position, second, two-position valve 72 prevents the flow of fluid therethrough. Second, two-position valve 72 is also biased in an opposite direction, i.e., to the left as viewed in the figure, by system pressure delivered through servo-valve 53 and supply lines 67 and 86.

When shifted to the right as viewed in the figure, second, two-position valve 72 permits fluid communication of third and fourth fluid conduits 49, 75 with a fifth fluid conduit 83. Fifth fluid conduit 83 comprises a loop, a portion of which is defined by an inertance device 89. Inertance device 89 is adapted to control the rate of flow of fluid through fifth fluid conduit 83 in order to control the pressures or rate of change of pressures in conduits 49 and 75, and hence the pressures in variable volume chambers 26 and 28 when piston 22 is subjected to an external force, as will be discussed more fully below.

Inertance device 89 essentially is a flow constrictor device that may be variable, if desired, to control the rate of flow of fluid between the input port and exhaust port of the device. The length and cross section of inertance device 89 is tailored or tuned to the particular actuator 4 so that the desired stiffness vs. frequency characteristics are obtained. Once a tuned inertance device 89 is installed, its operational characteristics remain constant. In general, the inertance device itself is constructed in accordance with any acceptable principal or structure known to a person of ordinary skill in the art and is not intended per se to constitute inventive subject matter in this application.

For example, the actual construction of inertance device 89 may take any form known in the art such as a straight length of tubing, a coil length of tubing, a drilled passage, a stack of fluidic laminates each of which comprises a segment of the device or the like. Inertance device 89 may have a constant or varying, round or any polygonal cross-sectioned shape. The important dimensions of inertance device 89, of course, normally would be its cross-sectional area for fluid flow and its length, as these dimensions will determine the frequency response of stiffness enhancing circuit 1 when installed in association with an actuator 4.

Fifth fluid conduit 83 has fluidly connected thereto a pair of drain lines 93, 94 at either end of inertance device 89. Drain lines 93, 94 are connected to a system return line 96 through respective one-way check valves 99 and 100. System return line 96 extends from its connection with drain lines 93 and 94 to sump tank or reservoir 58. One-way check valves 99 and 1 00 prevent the flow of fluid from drain lines 93 and 94 into system return line 96 respectively if the fluid pressure in drain lines 93 and 94 is higher than the fluid pressure in system return line 96.

The operation of stiffness enhancing circuit 1 will now be explained in detail, however, it should be understood that although stiffness enhancing circuit 1 is only shown as used with variable volume chambers 26 and 28, the circuit could also be used with the other two actuator chambers (not labeled) of the dual tandem linear actuator 4, or a separate circuit for these chambers could be provided. Servo-valve 53 is adapted to receive fluid pressure from pump 55 through supply line 56 and to output system pressure through conduits 43 and 47, along with supply line 67. Under normal operating conditions, first, two-position valve 45 is positioned as shown in FIG. 1 since the system pressure supplied to line 68 through line 67 is greater than the biasing force created by spring 61 and therefore a desired pressure can be supplied to first and second variable volume chambers 26 and 28. In addition, under normal operating conditions, second, two-position valve 72 is shifted to the left as depicted in FIG. 1 to prevent fluid communication of conduits 49 and 75 with loop 83. Second, two-position valve 72 is maintained in this position by the force created by the system pressure acting thereupon through line 86, against the biasing force of spring 77.

In the event of a system failure that causes a loss of system pressure within at least one of first and second variable volume chambers 26 and 28, the change in pressure in conduits 43 and 47 will cause servo-valve 53 to shift and thereby cause a lowering of the fluid pressure delivered to line 67. The pressure in line 67 is reduced to a point which creates a force on first and second, two-position valves 45 and 72 which is less than the force exerted by springs 61 and 77. Therefore, first, two-position valve 45 is caused to shift to the left thereby preventing the flow of fluid from servo-valve 53 to supply conduits 43 and 47. Instead, supply conduits 43 and 49 are interconnected through second, two-position valve 72 and loop 83, In this operational position, the flow of fluid between first and second variable volume chambers 26 and 28 must pass through inertance device 89. In this manner, as stated above, inertance device 89 can control the flow rate of fluid therethrough in order to control the pressures in first and second variable volume chambers 26 and 28, thereby controlling the stiffness of linear actuator 4.

Computer simulation of the above described system using elongated tubes having varying cross-sectional areas and lengths as inertance device 89 resulted in the following stiffness versus frequency data:

| Tube Dimensions | | | Total | Real Component |
|---|---|---|---|---|
| Area ($in^2$) | Length (in.) | Frequency (Hz) | Stiffness (lbs/in) | of Stiffness (lbs/in) |
| .006 | 36 | 20 | 1379300 | 509990 |
| | | 30 | 1538500 | 1510700 |
| | | 40 | 1290300 | 1287900 |
| | | 64 | 1111000 | 1109600 |
| .004 | 12 | 20 | 494000 | 343160 |
| | | 30 | 1539000 | 951730 |
| | | 40 | 1600000 | 1536500 |
| .0055 | 36 | 15.9 | 727270 | 347070 |
| | | 20 | 1538500 | 928040 |
| | | 25 | 1666700 | 1521400 |
| | | 30 | 1481500 | 1474000 |

It should be noted that the total stiffness of the non-failing chamber of the actuator used in determining the above-listed figures was 548,000 lbs/in.

From the above experimental figures it should be apparent that the stiffness enhancing circuit 1 of the present invention provides for little resistance to motion at low, control frequencies (as evidenced by the low real stiffness) and yet provides great resistance to high frequency forces (as evidenced by the greatly increased real stiffness). This is highly beneficial in many use environments, such as in aerospace applications.

It should be noted that various changes and/or modifications may be made to the invention without departing from the spirit of the invention. For instance, the supply of system pressure delivered to lines 67, 68 and 86 need not be made through servo-valve 53 but could be delivered through a separate flow control valve.

We claim:

1. A fluidic stiffness enhancing system for use with a fluid driven actuator comprising:

a fluid driven actuator including a piston and an enclosing cylinder, said piston being movably mounted within said cylinder so as to divide said cylinder into first and second variable volume chambers;

a source of system pressure;

regulating means, fluidly connected to said source of system pressure, for supplying a controlled supply of fluid pressure;

first conduit means for interconnecting said regulating means with said first and second variable volume chambers;

first valve means interposed in said first conduit means between said first and second variable volume chambers and said regulating means, said first valve means being shiftable between first and second operating positions wherein, in the first operating position, said first valve means fluidly interconnects said first and second variable volume chambers with said regulating means and, in the second operating position, said first valve means prevents fluid communication between said first and second variable volume chambers and said regulating means through said first conduit means;

a system return line;

second conduit means for interconnecting the first and second variable chambers, said second conduit means including an inertance device for restricting the free flow of fluid of fluid through said second conduit means and a drain line in fluid communication with said system return line, said second conduit means also including at least one one-way check valve located in said drain line;

second valve means interposed in said second conduit means between said first and second variable volume chambers and said inertance device, said second valve means being shiftable between first and second operating positions wherein, in the first operating position, said second valve means prevents fluid communication between said first and second variable volume chambers through said second conduit means and, in the second operating position, said second valve means fluidly interconnects said first and second variable volume chambers through said inertance device; and means for shifting said first and second valve means between their respective first and second operating positions whereby said first and second valve means are normally maintained in their respective first operating positions, however, in the event wherein fluid pressure to to at least one of said first and second variable volume chambers is lost, said first and second valves are shifted to their respective second operating positions to control the fluid pressures in said first and second variable volume chambers so as to enhance the stiffness of said actuator.

2. A fluidic stiffness enhancing system as claimed in claim 1, wherein two one-way check valves are provided in said drain line on either side of said system return line, said one-way check valves preventing the flow of fluid from said drain line into said system return line when the fluid pressure with the drain line is higher than the fluid pressure in said system return line.

3. A fluidic stiffness enhancing system as claimed in claim 1, wherein said regulating means includes a servo-valve fluidly interposed in said first conduit means between said first valve means and the source of system pressure.

4. A fluidic stiffness enhancing system as claimed in claim 1, wherein said shifting means includes a first means for biasing said first and second valve means to their respective second operating positions and a second means for biasing said first and second valve means to their respective first operating positions against the biasing force of said first biasing means.

5. A fluidic stiffness enhancing system as claimed in claim 4, wherein said second biasing means comprises fluid pressure acting on said first and second valve means.

6. A fluidic stiffness enhancing system as claimed in claim 5 wherein the fluid pressure acting on said first and second valve means is at system pressure.

7. A fluidic stiffness enhancing system as claimed in claim 4, wherein said first biasing means comprises a spring device.

* * * * *